US005495817A

United States Patent [19]

Zeigler, Sr. et al.

[11] Patent Number: 5,495,817

[45] Date of Patent: Mar. 5, 1996

[54] PEDAL MECHANISM FOR OPERATING PRESSER AND MOTOR IN SEWING MACHINES

[75] Inventors: Roger D. Zeigler, Sr.; John F. Matsko, Jr., both of Middleburg, Pa.

[73] Assignee: Blough-Wagner Manufacturing Co., Inc., Middleburg, Pa.

[21] Appl. No.: 446,420

[22] Filed: May 22, 1995

[51] Int. Cl.[6] ..... D05B 69/06; D05B 69/08; G05G 13/00

[52] U.S. Cl. ..... 112/217.3; 112/237; 112/DIG. 3; 74/512

[58] Field of Search ..... 112/60, 217.1, 112/217.3, 217.4, 271, 274, 276, 237, 239, DIG. 2, DIG. 3, 2.1; 74/512, 513, 514, 519, 522.5, 560, 561; 108/50, 150, 7, 20; 248/677, 188.1, 188.6

[56] References Cited

U.S. PATENT DOCUMENTS

| | | | |
|---|---|---|---|
| 2,609,262 | 9/1952 | Godshall et al. | 112/217.3 |
| 3,083,654 | 4/1963 | Cash, Sr. | 112/2.1 |
| 3,245,369 | 4/1966 | Myska | 112/239 X |
| 3,327,662 | 6/1967 | Abate et al. | 112/217.3 |
| 5,067,368 | 11/1991 | Itakura et al. | 74/560 |
| 5,220,877 | 6/1993 | Redovian | 112/237 |

FOREIGN PATENT DOCUMENTS

| | | | |
|---|---|---|---|
| 3909271 | 10/1989 | Germany | 112/217.3 |

*Primary Examiner*—Ismael Izaguirre
*Attorney, Agent, or Firm*—Thomas E. Sterling

[57] ABSTRACT

This invention is a dual foot pedal control for a sewing machine consisting of a foot activated tiltable pedal assembly mounted on a base member which is attached to a stabilizing mat. The stabilizing mat is positioned between the legs of a sewing machine table, on which a sewing machine is mounted. The tiltable pedal assembly is connected by rod to a sewing machine control arm which activates the sewing machine. In addition, the sewing machine is speed controlled by the counter-clockwise pressure on the pedal assembly which is transmitted by rod to the sewing machine control arm. The pedal assembly, when foot-tilted clockwise, activates an air control valve which directs compressed air to an air cylinder which is connected to and opens the presser foot of the sewing machine. When tilted counter-clockwise the air control valve dissipates air to the air cylinder allowing the presser foot to lower and clamp the material to be sewn.

15 Claims, 6 Drawing Sheets

PEDAL MECHANISM FOR OPERATING PRESSER AND MOTOR IN SEWING MACHINES

BACKGROUND OF THE INVENTION

1. Field of the Invention

This invention relates to an improved pedal mechanism for operating sewing machines and in particular to sewing machines controlled by a standing operator.

SUMMARY OF THE INVENTION

This pedal mechanism was designed to accomodate sewing machines that have been modified for stand-up sewing. It was determined that this pedal mechanism was ergonomically correct resulting from studies in an actual factory setting.

With the trend in the sewing industry heading toward stand-up modular sewing it was decided that an effort had to be made to develop a pedal mechanism that could be used to drive sewing machines that have the older clutch-type motors, as well as machines with the new type motors that are electronically operated. This pedal mechanism will allow for the modification of existing sewing machines, as well as new machines, to be utilized in stand-up sewing and at a reasonable cost. The pedal mechanism is very versatile and has the capability of accepting air hook-ups to operate various functions on an industrial sewing machine.

There are many inventions relating to pedals for controlling sewing machines. Many are designed with multi-pedals and most are designed for sewing machines operating with an operator in a sitting position. An example is U.S. Pat. No. 5,067,368 by Itakura et al. The present if related to a stand-up modular sewing machine in which the operator is on his feet during the sewing operation. The operator controls the sewing machine in the manner to be described, by the manipulation of only two foot pedals. This invention permits the control of the sewing machine in a stand-up position with the efficiency, simplicity and ease of operation.

In addition, in case of a breakdown, this pedal mechanism and the connected sewing machine may be easily disconnected from its compressed air power source and be wheeled away on attached swivel wheels. A new operable unit of pedal mechanism and sewing machine may be then wheeled in and easily attached and operation resumed.

The pedal mechanism is comprised of two foot pedals which are depressed by the foot of a standing operator who is positioned in front of a stand-up type sewing machine. The left pedal, (as viewed by an operator facing a sewing machine), engages the clutch and by foot pressure controls the speed of the sewing machine. Depressing the right pedal disengages the clutch and engages the brake, stopping the sewing machine. Depressing the right pedal also, through a control valve, sends high-pressure air to an air cylinder which opens the presser foot of the sewing machine. Fabric to be sewn may then be placed under the presser foot. The pedal mechanism is attached to a flexible rubber mat which is positioned and clamped under the sewing machine.

The pedal mechanism is comprised of a pivot motion control arm with a center pivot pin. The pivot motion control arm can be activated by the two pedals which allow it to rotate clockwise or counter-clockwise, (as viewed by the standing operator). The pivot motion control arm is connected to motor clutch and brake rod coupled to the sewing machine. When pivot motion control arm rotates clockwise it brakes, disconnects the clutch and stops the sewing machine. This clockwise motion activates a compressed air valve to direct compressed air to an air cylinder which opens the presser foot of the sewing machine. The forward speed of the sewing machine is foot controlled by counter-clockwise rotation of the pivot motion control arm.

It is to be understood that clockwise and counter-clockwise motions of the motion control arm are by way of example only for a specific mode of operation and that the opposite rotation might be employed for another specific use of the invention. Likewise the positions of the right and left pedals could be reversed, for a specific use, without departing from the spirit of the invention.

The object of this invention is to construct a pedal mechanism control for a sewing machine operated by a standing operator.

Another object of this invention is to construct a two-pedal mechanism to control elevated industrial sewing machines.

Still another object of this invention is to construct a foot pedal designed to control sewing machines that have been modified for stand-up sewing.

Another object of this invention is to produce a pedal mechanism which may be easily adapted to control a number of different types of sewing machines.

Still another object of this invention is to produce a pedal mechanism which may be easily and quickly attached to or detached from a sewing machine of the stand-up type.

Yet another object of this invention is to create a pedal mechanism and sewing machine combination which, when inoperable, can be quickly and easily replaced by another operable pedal mechanism/sewing machine unit.

Another object of this invention is to create a pedal mechanism which is simple, easy to operate and efficient.

Still another object of this invention is to create a device which may be used on sewing machines with both clutch-type and electronic-type controls.

BRIEF DESCRIPTION OF THE DRAWINGS

These, and other objects of the invention, are more fully set forth by referring to the drawings and specifications, of which.

DESCRIPTION OF THE PREFERRRED EMBODIMENT OF THE INVENTION

Figure 1:
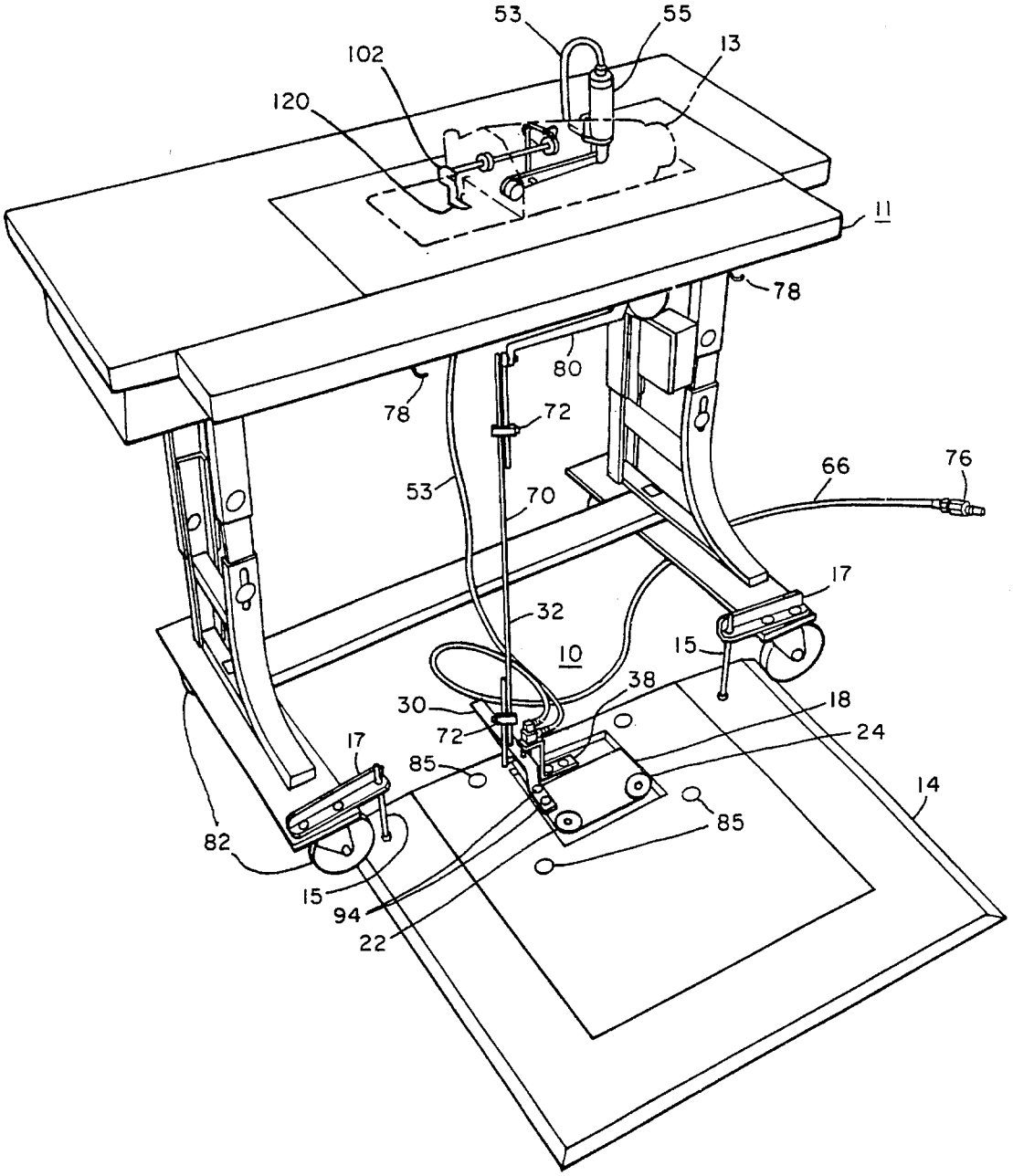
FIG. 1 is a perspective view of the overall construction of the invention coupled to a sewing machine, in phantom view, and showing the activating connections of the air cylinder to the presser foot of the sewing machine.
Figure 2:
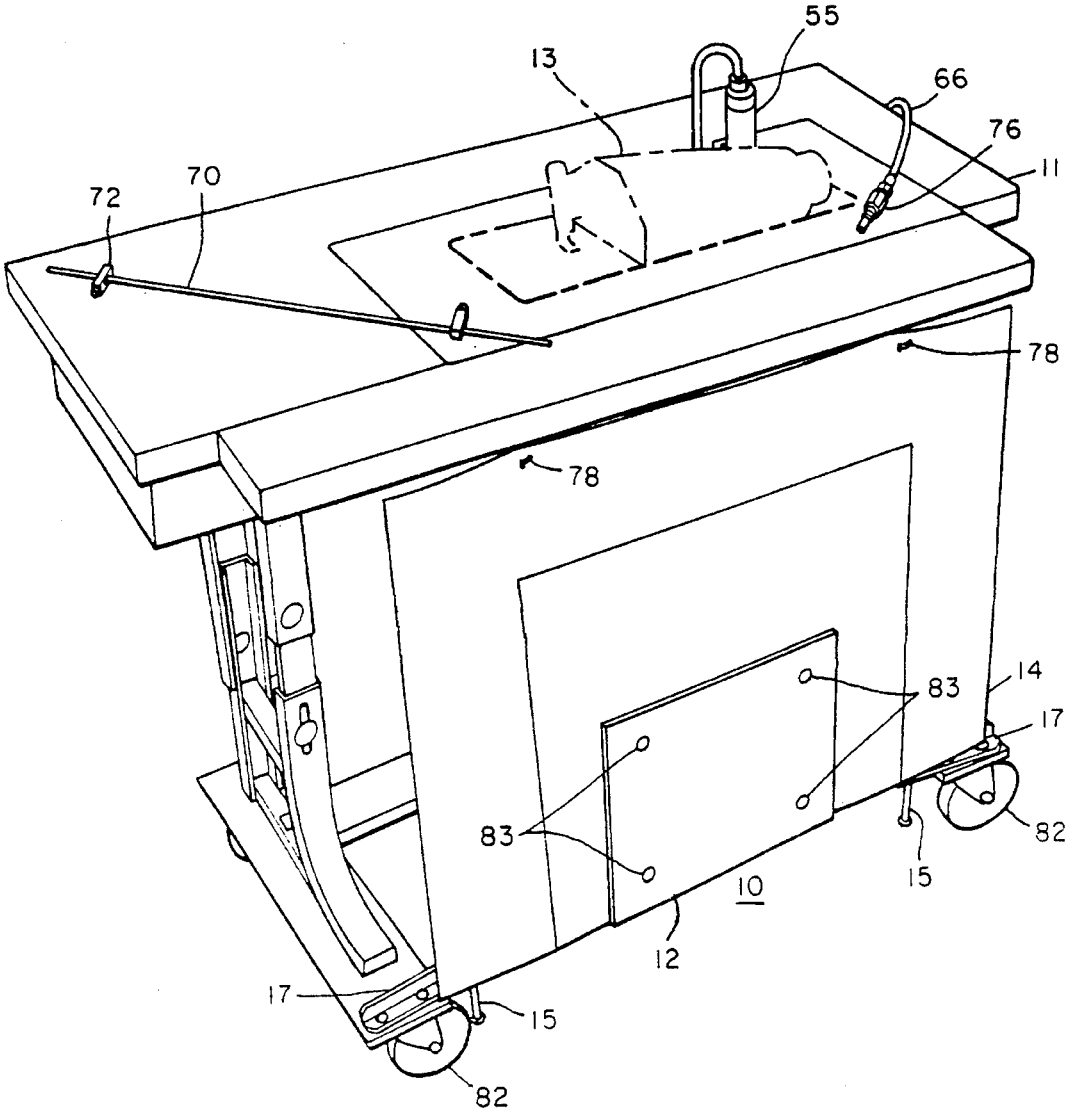
FIG. 2 is a perspective view of the view of the unit of FIG. 1 in its transport mode with the pedal mechanism and stabilizing mat supported by hooks, allowing the unit to be moved and air hose and control rods disconnected.

Referring to FIGS. 1 and 2, the pedal mechanism 10 of this invention is designed to operate a sewing machine 13

(FIG. 1 in dotted lines) that is mounted on an elevated sewing table 11, The sewing table 11 rests on four swivel wheels 82 which are attached to the lower corners of the sewing table 11. Thus it is possible to easily wheel about the sewing table 11, sewing machine 12 and attached pedal mechanism 10. The sewing table 11 has been elevated to be controlled by a standing operator. A height of about 36 ½ inches above the floor was found to be most efficient.

Figure 3:
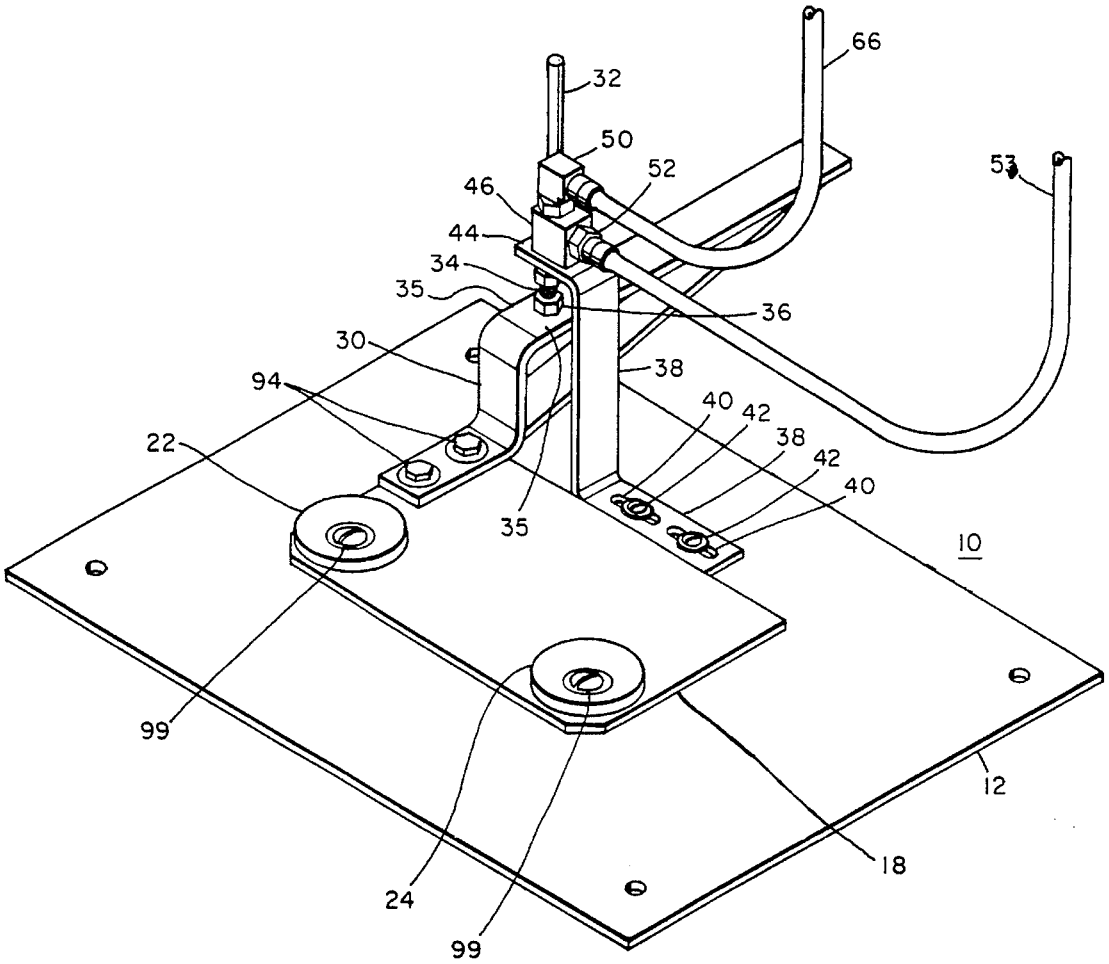
FIG. 3 is a prespective view of the pedal mechanism alone with disconnected air lines and control rod.
Figure 4:
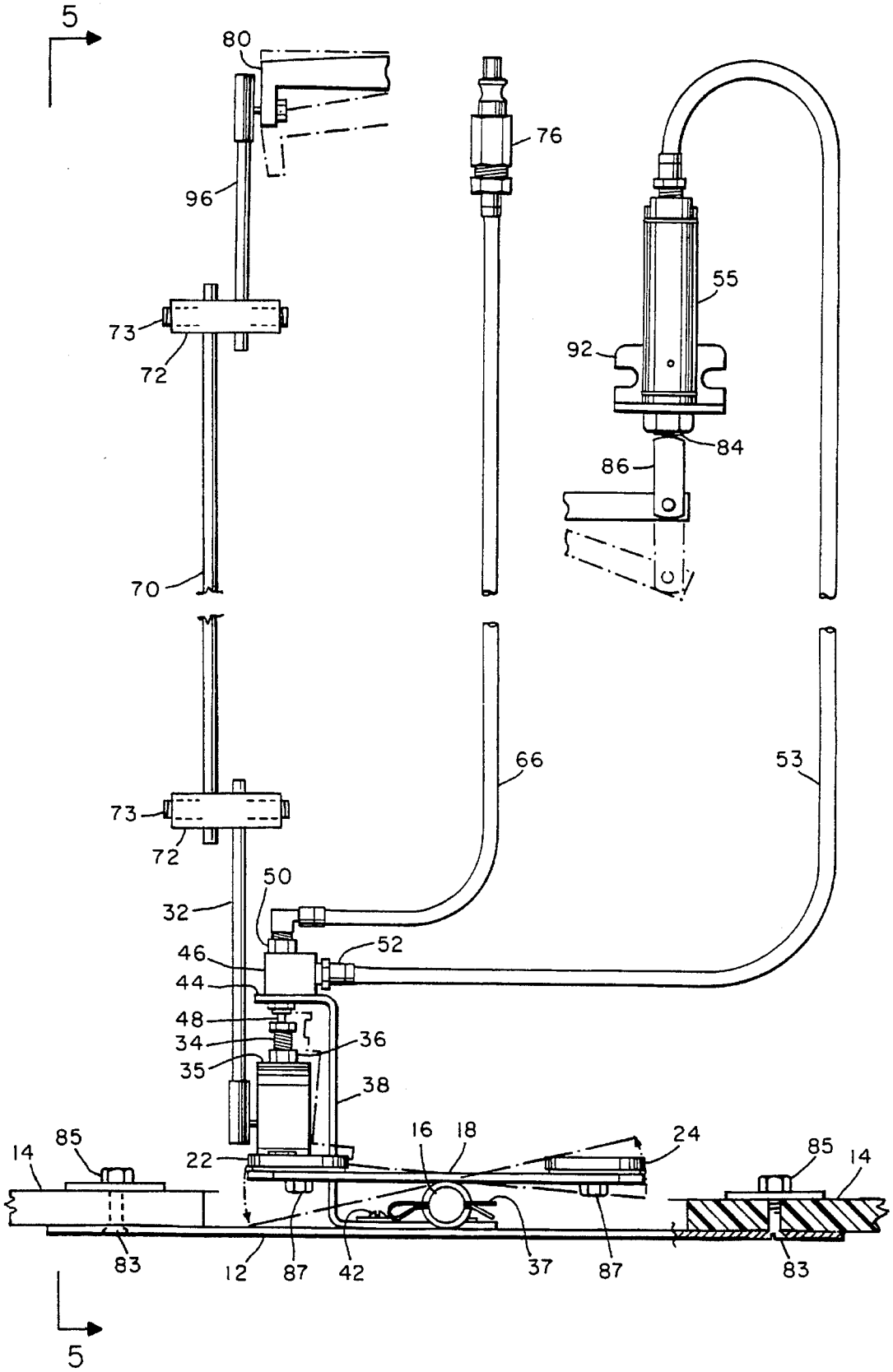
FIG. 4 is a front elevation view of the pedal mechanism showing the control rod and air line connections.
Figure 5:
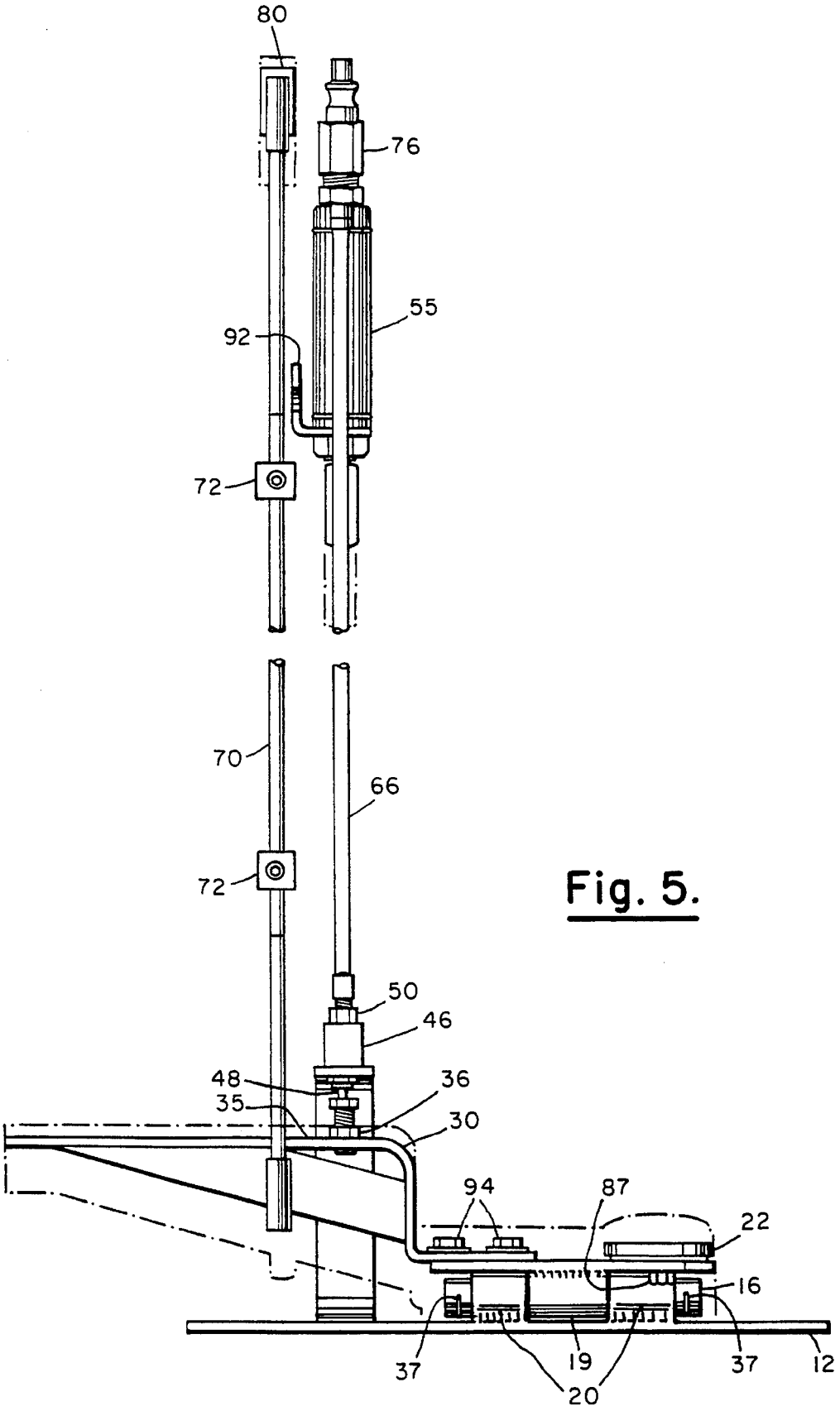
FIG. 5 is a side elevation view of the pedal mechanism.

Referring to FIGS. 3, 4 and 5, the pedal mechanism 10 is comprised of a base member 12 which is attached to four mat screws 83 mat nuts 85 to a stabilizing mat 14. Stabilizing mat 14 surrounds the base rectangular member 12 and is positioned in front of sewing table 11. The stabilizing mat 14 anchors the base member 12 to the floor so that it remains in one position. Stabilizing mat 14 is also held in position by two mat stabilizing rods 15, thread-attached to mat holding brackets 17 secured to the front of sewing table 11. The mat stabilizing rods 15 may be screwed to bear against stabilizing mat 14 to secure the stabilizing mat 14 and pedal mechanism 10 in position.

Figure 6:
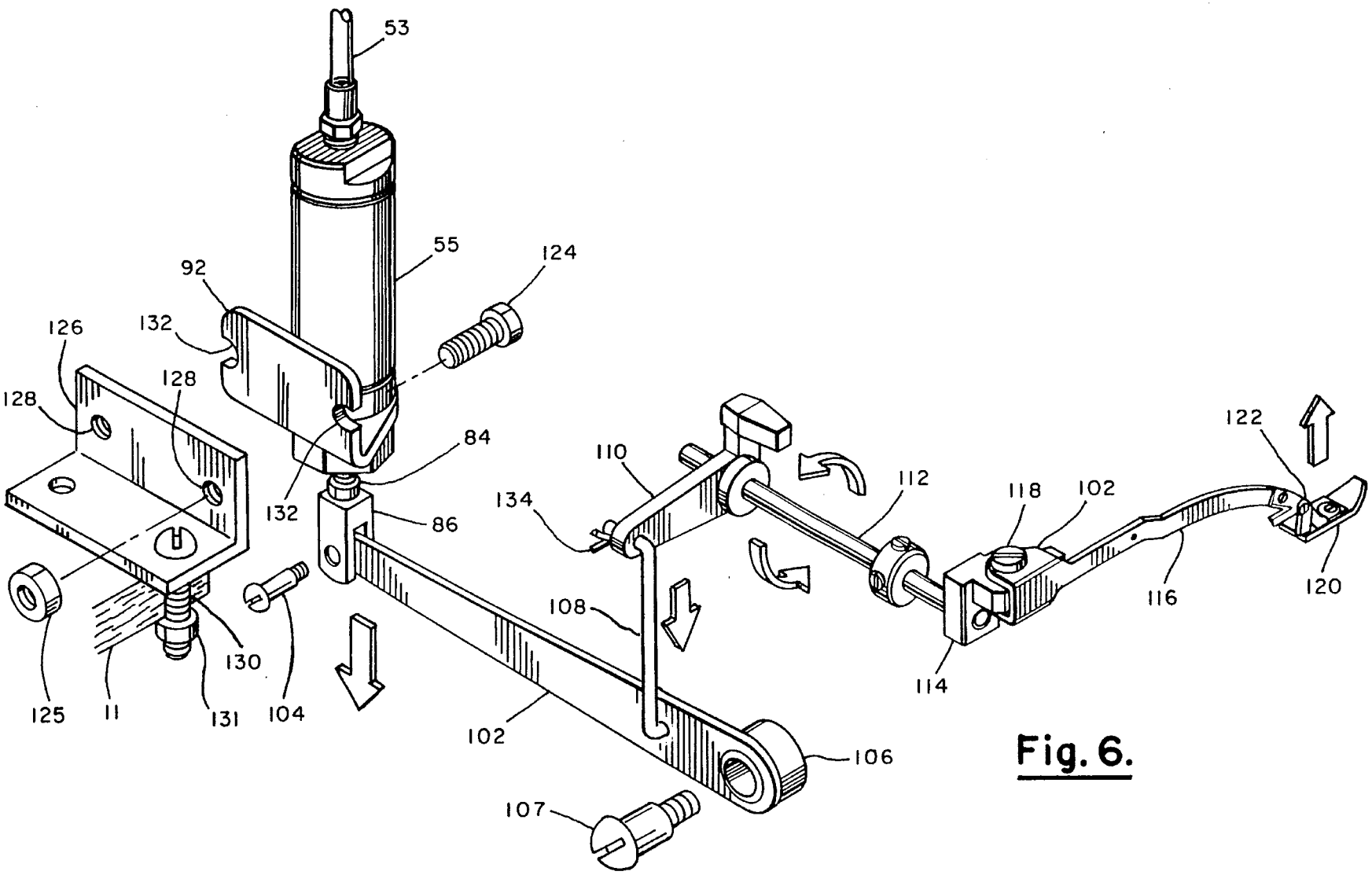
FIG. 6 is a rear perspective view showing the activating connections between the air cylinder and the presser foot of the sewing machine, in disassembled form.

Referring to FIGS. 5 and 6, a cylindrically-shaped pivot pin 16 is positioned within one inner sleeve 19 and two adjacent outer sleeves 20 which rest on the midportion of base member 12. The midsection of a motion control arm 18 is positioned and resting on inner sleeve 19 and outer sleeves 20. Inner sleeve 19 is then welded to motion control arm 18 and outer sleeves 20 welded to base member 12. Thus motion control arm 18 will pivot hinge-like upon pivot pin 16. Pivot pin 16 is retained in sleeves 19 and 20 by end-positioned cotter pins 37 extending through the end portion of pivot pin 16.

A motor-activating treadle pad 22 is screw-mounted on the motion control arm 18 on the left side (as the operator stands), of the pivot pin 16 (see FIGS. 4 and 5). A brake-activating treadle pad 24 is attached by pad screw 99 to motion control arm 18 on the right hand side of the pivot pin 16, as in FIGS. 4 and 5. Motor activating treadle pad 22 is attached to motion control arm 18 on the left side by pad screw 99. Pressing the brake-activating treadle pad 24 (on the right) will cause motion control arm 18 to pivot in a clockwise direction 26. Pressing the motor-activating treadle pad 22 (on the left) will cause the motion control arm 18 to pivot in a counter-clockwise rotation 28.

A motor clutch control arm 30 is secured by control arm bolts 94 to pivot motion control arm 18, adjacent to motor-activating treadle pad 22. This motor clutch control arm 30 has two 90° bends therein extending away from the base member 12 and then outwardly approximately parallel thereto. A motor clutch and brake rod 32 is swivelly attached to the motor clutch control arm 30 and extends upwardly therefrom where it controls sewing motor control arm 80 of the sewing machine 13.

The motor clutch and brake rod 32 has an extension rod 70 coupled thereto by two rod clamps 72 tightenable on extension rod 70 and motor clutch control arm 30, by rod screws 73. Rod clamps 72 have two holes through which extension rod 70, motor clutch and brake rod 32 and upper control rod 96 extend. Rod screws 73 are screw attached and extend through rod clamps 72 to clamp motor clutch and brake rod 32, upper control rod 96 and extension rod 70. The length of rod 32 can be adjusted by positioning rod clamps 72. The extension rod 70 may be removed from motor clutch and brake rod 32 by loosening rod clamps 72. The upper control arm 96 is swivelly attached to motor control arm 80 which controls the motor (not shown) of the sewing machine 13. Upper control arm 86 is also attached to extension rod 70 by a rod clamp 72. Vertical motion of control arm 80 starts, stops and controls the speed of the sewing machine 13 motor in a manner well known by all skilled in the art. Upward movement (toward sewing machine 13) of the motor clutch and brake rod 32 will raise sewing motor control arm 80 to disengage the sewing machine clutch (not shown), and engage the brake (not shown), to stop the sewing machine 13. Downward movement (away from sewing machine 13)of motor clutch and brake rod 32 will disengage the brake (not shown), engage the clutch (not shown) and operate the sewing machine 13 at the desired speed by controlling the downward movement of motion clutch and brake rod 32. This is done by increasing foot pressure on motor-activating treadle pad 22. An adjusting lock screw 34 extends through and is screw-attached to the upper surface 35 of the control arm 30. A lock bolt 36 screw-attached to adjusting lock screw 34 permits locking the adjusting lock screw 34 in position after it has been located at the correct height.

An adjustable control bracket 38 having adjustment slots 40 is positioned on base member 12. Adjustment screws 42 through adjustment slots 40 are screw-attached to the base member 12. By loosening the adjustment screws 42 the adjustment control bracket 38 may be moved in adjustment slots 40 to a proper position and then locked. Adjustment control bracket 38 has two 90° angles thereon whereby it extends upward and away from the base member 12 and then parallel thereto to form a valve mounting arm 44. Valve mounting arm 44 is positioned directly above the adjusting lock screw 34 when lock screw 34 is rotated in its highest position.

An air control valve 46 extends through and is thread-attached to valve mounting arm 44 directly above adjusting lock screw 34 when it is in its highest rotated position.

Air control valve 46 is of a standard industrial three-way type which upon activation directs high-pressure air from an inlet member 50 to an outlet member 52 and upon deactivation exhausts the high-pressure air from the outlet member 52 to the atmosphere through a valve-activating and exhaust plunger 48, A high-pressure air line 66 connects inlet member 50 of air control valve 46 to a source of high-pressure air (not shown). A pressure fitting 76 on air line 66 allows it to be easily connected to a source of high-pressure air. A well known Clippard Instrument Lab 3-way valve assembly, Model M.J.V.-3 was used in this invention. Air control valve 46 has a hollow valve-activating and exhaust plunger 48 extending therein which, when pressed, activates the air control valve 46. An inlet member 50 is then pressurized with high-pressure air. An outlet member 52 is connected to an air line 53 coupled to an air cylinder 55 attached to the foot control element 86 of the sewing machine 13.

Referring now to FIG. 6 air cylinder 55 is attached to encircling cylinder bracket 92 which has two bolt slots 132 therein. Air cylinder bolts 124 (one shown) extend through bolt slots 132 and into hole 128 in an L-shaped table bracket 126. Air cylinder nut 125 screws on air cylinder bolt 124 which bears against L-shaped table bracket 126 securing air cylinder 55 to L-shaped table bracket 126. L-shaped table bracket 126 rests on sewing table 11 and is bolted thereto by sewing table screws 130 (one shown). The table screw 130 extends through L-shaped table bracket 126 and through sewing table 11 and is retained there by sewing table nut 131. Thus air cylinder 55 is securely mounted on sewing table 11, It should be noted that air cylinder 55 may also be mounted on the sewing machine 13 or other stable object independent of the sewing table 11. When air cylinder 55 is pressurized, piston rod 84 is forced outwardly against foot control element 86 which forces the connected presser foot 120 to open. Dotted lines show the movement of foot control element 86.

In operation, when valve-activating and exhaust plunger 48 is depressed it allows high-pressure air to flow from inlet member 50 into outlet member 52. When valve-activating and exhaust plunger 48 is released, it stops the flow of high-pressure air to outlet member 52 and to air cylinder 55, At the same time it directs the high-pressure air in the outlet member 52 to exhaust through the valve-activating and exhaust plunger 48.

Air under pressure immediately flows from inlet member 50 to outlet member 52 and through cylinder air line 53 to air cylinder 55. The piston rod 84 of air cylinder 55 is forced outwardly moving foot control element 86. Dotted lines show the movement. Foot control element 86 is connected to the presser foot 120 causing the presser foot to open. At the same time the motor clutch brake rod 32 raises the motor control arm 80 which brakes and stops the sewing machine 13.

When the motor-activating treadle pad 22 is pressed, the motion control arm 18 moves in a counter-clockwise rotation, swinging the adjusting lock screw 34 out of contact with the valve-activating and exhaust plunger 48 which is spring-biased inward. Valve-activating and exhaust plunger 48 moves outwardly. This stops the flow of high-pressure air through air control valve 36 and allows the air in the outlet member 52 to exhaust through exhaust opening in the hollow valve-activating and exhaust plunger 48. The presser foot of the sewing machine 13 will then lower, clamping fabric to be sewn (not shown).

Referring again to FIG. 6, air cylinder 55 has a piston rod 84 which is pivotally connected to a presser foot control element 86. A foot activating arm 102 is pivotally connected to foot control element 86 where it is free to rotate about an arm pivot pin 104 extending through foot control element 86. The opposite end portion of foot activating arm 102 is connected to a foot pivot 106 which is securred by pivot bolt 107 to the chassis, or other portion, of sewing machine 13 (not shown) in such a manner that foot activating arm 102 will pivot on the pivot bolt 107.

An S-shaped pin 108 extends through foot activating arm 102 on one end. The opposite end of S-shaped pin 108 extends through an anvil-shaped arm 110 within the sewing machine 13 chassis, which is integrally connected to a foot shaft 112. Foot shaft 112 is rotatably supported within the sewing machine 13 so that it rotates on its axis as indicated by the arrows. The support is not shown as it is a part of well known sewing machine structure. S-shaped pin 108 has cotter pin 134 through the end portions thereof. The opposite end portion of foot shaft 112 is integrally connected to L-shaped member 114 which is connected to a foot activating arm 102 coupled to presser foot member 116 by a foot screw 118. Foot screw 118 extends through foot activating arm 102 and L-shaped member 114. The opposite end portion of presser foot member 116 is connected to presser foot 120 by foot securing screw 122. Anvil-shaped arm 110, foot shaft 112, foot activating arm 102, presser foot member 116 and presser foot 120 are clamped to one another and move as a unit. Anvil-shaped arm 110 and foot shaft 112 are usually within sewing machine 13 and a portion thereof and are part of the sewing machine 13.

In operation, when compressed air is directed through cylinder air line 53 to air cylinder 55, piston rod 84 extends outwardly, pressing foot control element 88 and foot activating arm 102 downward, (see arrows). Foot activating arm 102 rotates on foot pivot 106 and arm pivot pin 104. S-shaped pin 108 pulls anvil-shaped arm 110 downwardly, (see arrow). This rotates foot shaft 112 and presser foot member 116 causing presser foot 120 to rotate upward, (see arrow). Thus fabric may be placed in the sewing machine 13. Arrows on FIG. 6 indicate the motion of the above element to rotate the presser foot 120. When compressed air is evacuated from air cylinder 55 through air line 53, piston rod 84 retracts into air cylinder 55. A retracting spring, (not shown), in air cylinder 55 withdraws piston rod 84. All of the elements previously described then rotate in the direction opposite to that of the indicated arrows, presser foot 120 rotates closed, allowing the sewing machine 13 to operate.

Air cylinder bracket 92 may be attached to the sewing table 11, sewing machine 13 or to a support unconnected to the sewing machine 13, (not shown). Air cylinder 55 may be directly attached to sewing machine 13 without bracket 92. As may be seen, the presser foot 120 may be engaged by pressing bolt-activating treadle pad 24 which causes air-activating valve 46 to direct high-pressure air into air cylinder 55 through air line 53.

Likewise, depressing motor activating treadle pad 22 will cause air control valve 46 to evacuate high-pressure air through air line 53 and air cylinder 55, causing presser foot 120 to lower onto fabric to be sewn.

In the factory setting, when the pedal mechanism 10, sewing machine 13 and sewing table 11 must be replaced, as when a breakdown occurs, these units may be quickly and easily replaced by disconnecting the high-pressure air line 74. Extension rod 70 is then removed. The mat stabilizing rods 15 are loosened and the stabilizing mat 14 folded and hooked on mat hooks 78 positioned on the forward portion of sewing table 11. The entire assembly then can be wheeled out on swivel wheels 93 and another unit wheeled in and connected. Quick and easy replacement of the unit is thus possible.

It should be noted that the above description is by way of example only and that numerous modifications may be made without departing from the spirit of the invention.

I claim:

1. A pedal mechanism for controlling a sewing machine comprising in combination:

a base member;

a tiltable treadle pivotally and movably attached to said base member;

a motor control arm attached to said sewing machine;

a motor control bracket attached to said tiltable treadle;

a motor control member coupled to said motor control bracket and to said motor control arm of said sewing machine;

a valve support bracket adjustably attached to said base member and extending to juxtaposition with said motor control bracket;

a valve-activating member attached to said motor control bracket;

air control valve means attached to said valve support bracket and in juxtaposition with the rotation of said valve-activating member;

said air control valve means comprising in combination;

a valve-activating plunger attached to said air control valve means;

an inlet element in said air control valve means said inlet element connected to a pressure air line;

an outlet element in said air control valve means in controlled communication with said inlet element;

an exhaust element in said air control valve means said exhaust element in communication with the atmosphere and in controlled communication with said inlet element;

whereby upon depression of said activating plunger by said activating member, said inlet element is connected to said outlet element allowing pressured air to flow into said outlet element;

upon release of said activating plunger said outlet element is disconnected from said inlet element and said outlet element is connected with said exhaust element and the atmosphere;

an air cylinder in communication with said outlet element of said air control valve means;

a piston within said air cylinder;

a presser foot controlling means attached to said sewing machine and coupled to said piston.

2. The combination as claimed in claim 1 in which said tiltable treadle has a pivot pin positioned adjacent to said base plate;

a first sleeve encircling said pivot pin and said first sleeve attached to said motor control bracket;

a second sleeve encircling said pivot pin and said second sleeve attached to said base member.

3. The combination as claimed in claim 2 in which said base member has a stabilizing mat attached thereto and encircling said base member.

4. The combination as claimed in claim 3 in which said motor control member is comprised of:

clutch and brake rod rotatably attached to said motor control member;

an upper control rod rotatably attached to said motor control arm;

an extension rod removably clamped to said clutch and brake rod, and to said upper control rod.

5. The combination as claimed in claim 4 in which said valve-activating member is comprised of an adjustable lock screw attached to said motor control bracket, said adjustable lock screw in controlled pressure contact, with said activating plunger, and adapted to activate said air control valve means.

6. The combination as claimed in claim 5 having a foot pad attached to said tiltable treadle on each side of said pivot pin.

7. The combination as claimed in claim 6 in which said pivot pin has a cotter pin therethrough on both ends thereof.

8. The combination as claimed in claim 7 having a spring-biased piston in said air cylinder coupled to said presser foot control means;

a presser foot connected to said presser foot control means;

whereby on pressurization of said air cylinder said piston will press against said presser foot control means causing said presser foot to raise.

9. The combination as claimed in claim 8 in which said air control valve means is comprised of a three-way valve assembly.

10. The combination as claimed in claim 9 in which said presser foot means is comprised of a foot-activating arm, one end of which is pivotally attached to said piston, the opposite end portion being pivotally attached to a stationary pivot screw;

a pin swivelly attached to said foot-activating arm;

a rotatable presser foot element having a presser foot attached thereto, swivelly connected to said pin;

whereby movement of said foot-activating arm will cause said presser foot element to rotate, to raise or lower said presser foot.

11. The combination as claimed in claim 10 in which said valve support bracket has an adjustment slot therein;

an adjustment screw extending through said adjustment slot thread-attached to said base member;

whereby said valve support bracket may be moved within said adjustment slot and clamped to said base member by said adjustment screw.

12. The combination as claimed in claim 11 having a sewing table on which said sewing machine is mounted;

swivel wheels attached to said sewing table in supporting contact with the floor.

13. The combination as claimed in claim 12 having a mat stabilizing rod in adjustable screw contact with said mat and said sewing table, adapted to clamp said stabilizing mat in non-movable position.

14. The combination as claimed in claim 13 in which said sewing table has a hook therein adapted to engage and support said stabilizing mat when said sewing table is moved.

15. The combination as claimed in claim 14 in which said air cylinder is attached to said sewing table.

* * * * *